United States Patent [19]

Rodriquez

[11] 4,052,065

[45] Oct. 4, 1977

[54] PROJECTILE CATAPULT AND BAT TOY

[76] Inventor: Jose Rodriquez, 750 E. 166th St., Apt. 10A, Bronx, N.Y. 10456

[21] Appl. No.: 717,237

[22] Filed: Aug. 24, 1976

[51] Int. Cl.[2] ..... A63B 59/06; A63B 67/12

[52] U.S. Cl. ..... 273/95 F; 273/72 R; 124/16

[58] Field of Search ..... 273/95 F, 72; 124/16

[56] References Cited

U.S. PATENT DOCUMENTS

| | | | |
|---|---|---|---|
| 1,873,211 | 8/1932 | Nekuda | 273/95 F |
| 1,903,539 | 4/1933 | Warner | 273/95 F |
| 2,705,003 | 3/1955 | Schensted | 124/16 |
| 3,104,876 | 9/1963 | Salsinger | 273/72 R |

FOREIGN PATENT DOCUMENTS

| | | | |
|---|---|---|---|
| 375,413 | 1932 | United Kingdom | 273/95 F |

*Primary Examiner*—Richard C. Pinkham
*Assistant Examiner*—Lawrence E. Anderson
*Attorney, Agent, or Firm*—Allen D. Brufsky

[57] ABSTRACT

A catapult comprising a stand and a spring-mounted plunger receives a projectile which is struck by a bat having at least one flat side to propel to the projectile into the air where it is struck again by the bat.

6 Claims, 4 Drawing Figures

PROJECTILE CATAPULT AND BAT TOY

BACKGROUND OF THE INVENTION

This invention relates to a toy, and more particularly, a toy including a projectile positioned on a stand which when struck with a baseball bat will catapult into the air wherein it can be struck again.

By virtue of use of the toy of the present invention many hours of enjoyment may be realized by a sole player. While the game of baseball requires at least a pitcher and a batter, or two players, a baseball game can be simulated by a sole player with the toy apparatus of the present invention.

SUMMARY OF THE INVENTION

In accordance with the invention, an upright stand is provided having a spring-mounted plunger. A cylindrical projectile provided with an inclined surface at one end is seated on the plunger with the inclined surface in contact with a rotatable pin on the stand. A bat having a hexagonal cross-section presenting six flat surfaces is used to strike the body of the projectile mounted on the stand. When struck, the projectile is flung into the air by the spring-mounted plunger block, the projectile having been placed by the rotatable pin to vary the trajectory of the projectile presented to the player, who strikes at the projectile a second time when airborne, to propel it with the bat. The stand can be provided with a storage compartment for housing a number of projectiles.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
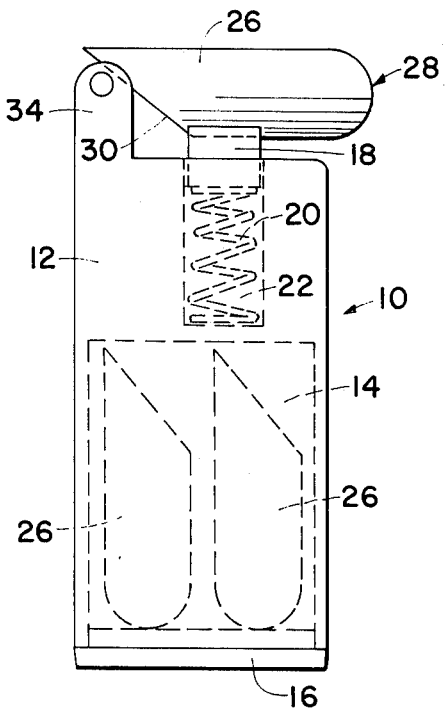
FIG. 1 is a side view in elevation of the projectile catapult and projectile of the toy of the present invention.
Figure 2:
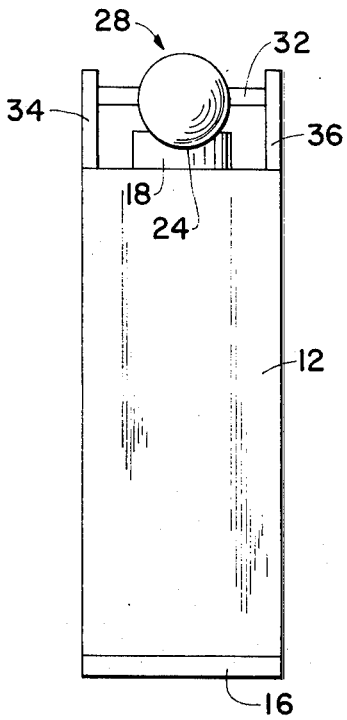
FIG. 2 is a front view in elevation of the projectile catapult and projectile of FIG. 1.
Figure 3:
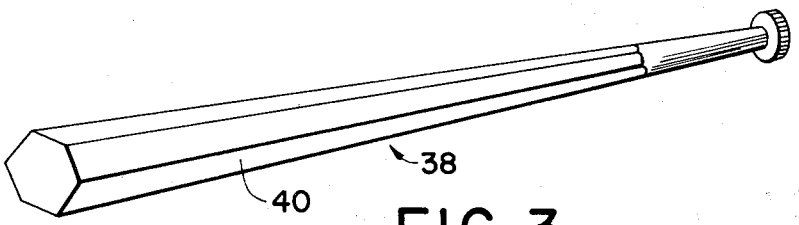
FIG. 3 is a perspective view of the bat of the toy used to strike the projectile shown in FIG. 1.
Figure 4:
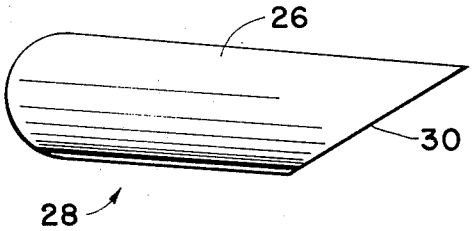
FIG. 4 is a side view in elevation of the projectile of FIG. 1.

Referring now in detail to the drawing, wherein like numerals indicate like elements throughout the several views, the toy apparatus 10 of the present invention includes a projectile catapult in the form of a stand 12 having a hollow projectile storage compartment 14 covered by a removable base 16.

Stand 12 includes a plunger block 18 mounted by a coil spring 20 for reciprocable movement in a bore 22 in stand 12. Plunger block 18 includes a semi-cylindrical groove 24 for receiving the cylindrical body 26 of a rubber projectile 28. Projectile 28 is provided with an inclined surface 30 at one end which normally rests on a horizontal pin 32 rotatably mounted between upright pintles 34, 36 on the top of stand 12.

A bat 38 having a hexagonal cross-section presenting six flat surfaces 40 is used to strike the body 26 of projectile 28. When struck, projectile 28 is catapulted into the air by plunger block 18 with varying spin provided by pin 32. The player strikes at the projectile 28 when it is airborne, to propel it a second time with bat 38.

I claim:

1. A toy comprising:

a stand;

a spring-mounted plunger on said stand;

a projectile having a cylindrical body and an inclined end surface adapted to be mounted on said plunger;

a rotatable pin on said stand, means mounting said pin in a position to contact the inclined surface of said projectile when said projectile is mounted on said plunger; and a bat having at least one flat side for striking said projectile on said stand and in the air.

2. A toy in accordance with claim 1, wherein said plunger includes a semi-cylindrical groove receiving the cylindrical body of said projectile.

3. A toy in accordance with claim 1, wherein said pin is mounted between a pair of upright pintles on said stand.

4. A toy in accordance with claim 1, wherein said bat is hexagonal in cross-section.

5. A toy in accordance with claim 1, wherein said stand includes a compartment for storing said projectile, and a cover for said compartment.

6. A toy in accordance with claim 1, wherein said stand includes a bore, and a coil spring mounts said plunger in said bore.

* * * * *